United States Patent [19]

Musso et al.

[11] Patent Number: 4,723,856

[45] Date of Patent: Feb. 9, 1988

[54] DEVICE FOR COUPLING A CHARACTER-CARRYING DISC TO A SELECTOR MOTOR

[75] Inventors: Pietro Musso; Ugo Carena, both of Ivrea, Italy

[73] Assignee: Ing. C. Olivetti & C., S.p.A., Ivrea, Italy

[21] Appl. No.: 824,311

[22] Filed: Jan. 30, 1986

Related U.S. Application Data

[63] Continuation of Ser. No. 582,777, Feb. 23, 1984, abandoned.

[30] Foreign Application Priority Data

Feb. 28, 1983 [IT] Italy ..... 67223 A/83

[51] Int. Cl.[4] ..... B41J 1/30

[52] U.S. Cl. ..... 400/175; 400/144.2

[58] Field of Search ..... 400/144.2, 144.3, 163, 400/174, 175

[56] References Cited

U.S. PATENT DOCUMENTS

| | | | |
|---|---|---|---|
| 3,878,929 | 4/1975 | Orlens et al. | 400/144.3 X |
| 4,036,348 | 7/1977 | Guerrini | 400/175 X |
| 4,124,312 | 11/1978 | Johnson | 400/144.2 |
| 4,264,220 | 4/1981 | Okcuoglu | 400/144.2 |
| 4,299,502 | 11/1981 | Harre | 400/144.2 |
| 4,338,034 | 7/1982 | Babler | 400/175 X |
| 4,389,130 | 6/1983 | Giolitti | 400/175 |
| 4,403,876 | 9/1983 | Vought | 400/175 X |
| 4,507,001 | 3/1985 | Babler | 400/175 |
| 4,553,868 | 11/1985 | Crosio | 400/175 |

FOREIGN PATENT DOCUMENTS

| | | | |
|---|---|---|---|
| 0086760 | 7/1981 | Japan | 400/144.2 |
| 7808762 | 2/1980 | Netherlands | 400/175 |
| 2027394 | 2/1980 | United Kingdom | 400/175 |

OTHER PUBLICATIONS

IBM Technical Disclosure Bulletin, "Impact Printer with Cassette Daisy Wheel Type Font", by Roberti et al., vol. 20, No. 1, 6–78, pp. 1–3.

*Primary Examiner*—William Pieprz

*Attorney, Agent, or Firm*—Banner, Birch, McKie & Beckett

[57] ABSTRACT

The device comprises a flange (14) which is fixed to the shaft (12) of the motor and which is provided on its front face with a plurality of radial teeth (28) spaced by recesses each having their active side surfaces parallel to each other and to the radial line through the recess. Removably connected to the character-carrying disc (11) coaxially therewith is another disc (35) of smaller diameter which is provided on its outward front surface with radial teeth (48) having their active side surfaces (50) parallel to each other and capable of being coupled to the radial recesses of the flange which is fixed to the motor shaft. On the other front surface, hooks (38, 39) engage in holes (21, 23) in the disc. In an alternative embodiment the teeth (48) are integral with the hub (16) of the disc (11) itself.

9 Claims, 8 Drawing Figures

DEVICE FOR COUPLING A CHARACTER-CARRYING DISC TO A SELECTOR MOTOR

Figure 1:
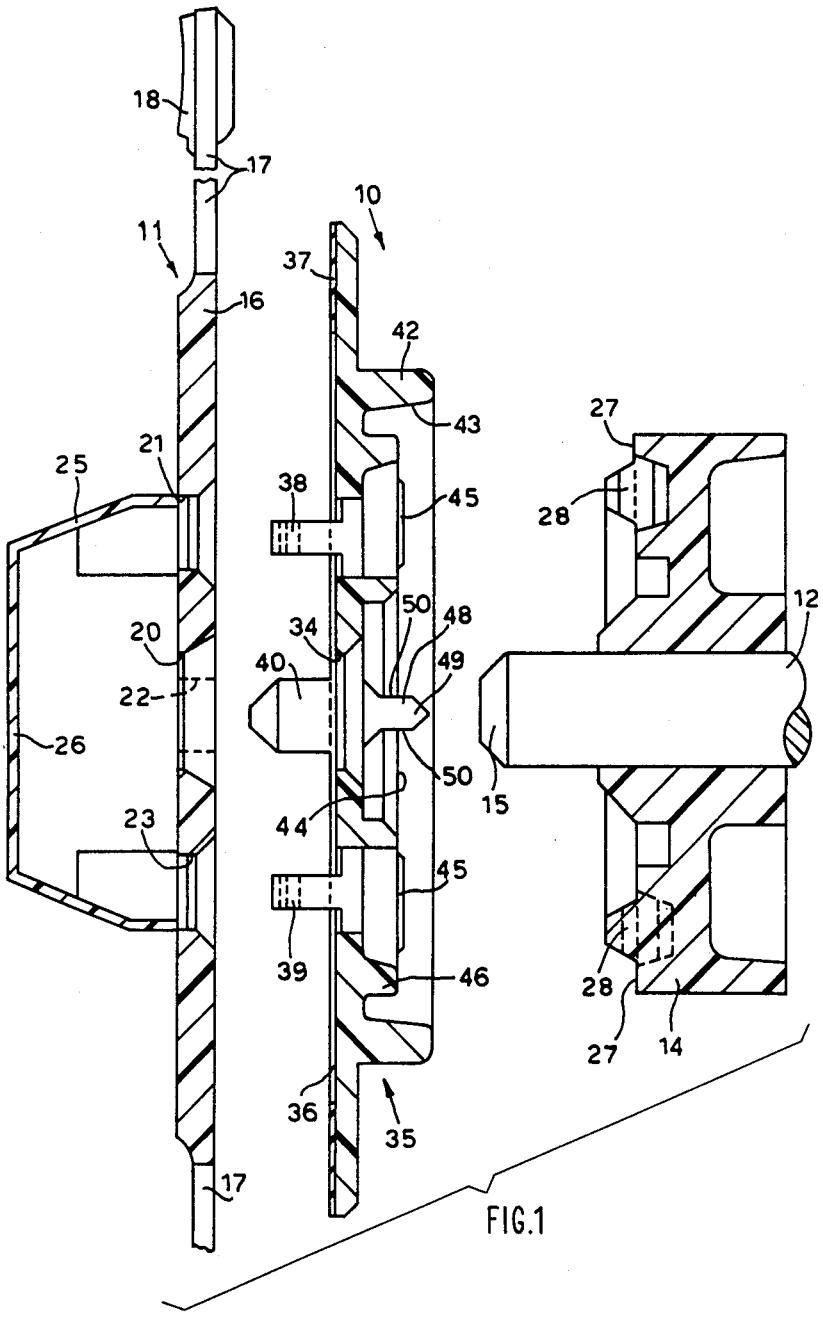

This application is a continuation, of application Ser. No. 582,777, filed Feb. 23, 1984, now abandoned.

The present invention relates to a device for coupling a character-carrying disc having flexible blade portions (commonly called a daisywheel) to the shaft of a selector motor of an office printing machine, for example a typewriter.

Normally, in order to couple a character-carrying disc to the shaft of the selector motor, the disc itself is provided with cavities spaced from the axis of rotation and corresponding resilient hook members mounted on a flange fixed on the motor shaft co-operate with the cavities.

In order to facilitate making the kind of coupling, which has to be done with precision on the part of the operator, it is necessary for the selector motor to be greatly inclined. This is required because the operator must first position the character-carrying disc angularly with respect to the motor shaft in order to line up the lateral cavities in the disc with the resilient hook members and then move the disc axially towards the flange to make the connection therebetween. In addition, the operator must first remove the cartridge containing the inked ribbon and then refit it when the connection has been made.

Another system for coupling a character-carrying disc to the shaft of a selector motor is also known, wherein the disc is provided on its front with a plurality of angularly equally spaced radial teeth which are of a wedge-shaped configuration thereby to define radial V-shaped recesses. Fixed to the motor shaft is a flange which is provided on its front with an equal number of radial recesses and teeth which are of the same shape as those provided on the disc and which are capable of coupling therewith.

However, that type of connecting arrangement requires very accurate tolerances, in particular in regard to the coaxial positioning of the disc with respect to the flange fixed to the motor shaft. In fact, with the teeth of the disc and the flange being of wedge-shaped configuration and converging towards the axis of rotation, a minor error in regard to coaxial positioning thereof would cause imperfect coupling therebetween, if not totally preventing the coupling from being made. Indeed, in the known arrangement, a further member for precise angular positioning was provided in order to correct inevitable errors in angular positioning, due to the type of coupling arrangement. Accordingly therefore, that system is complicated and expensive.

The object of the present invention is to provide a device for coupling a character-carrying disc to a shaft of a selector motor, which, while not requiring highly precise tolerances between the components to be coupled, is at the same reliable and simple.

That problem is solved by the device according to the present invention which comprises a flange which is fixed to the shaft of the motor and which is provided on its front with a plurality of angularly equally spaced radial teeth which are spaced by a plurality of recesses, and is characterised in that at least one tooth is provided on a front surface which is orthogonal to the axis of rotation of the character-carrying disc for coupling to one of the recesses of the flange, and that both the tooth associated with the disc and each recess provided on the flange has the active side surfaces parallel to each other and to the radial line which passes through the tooth or through the recess respectively.

Figure 2:
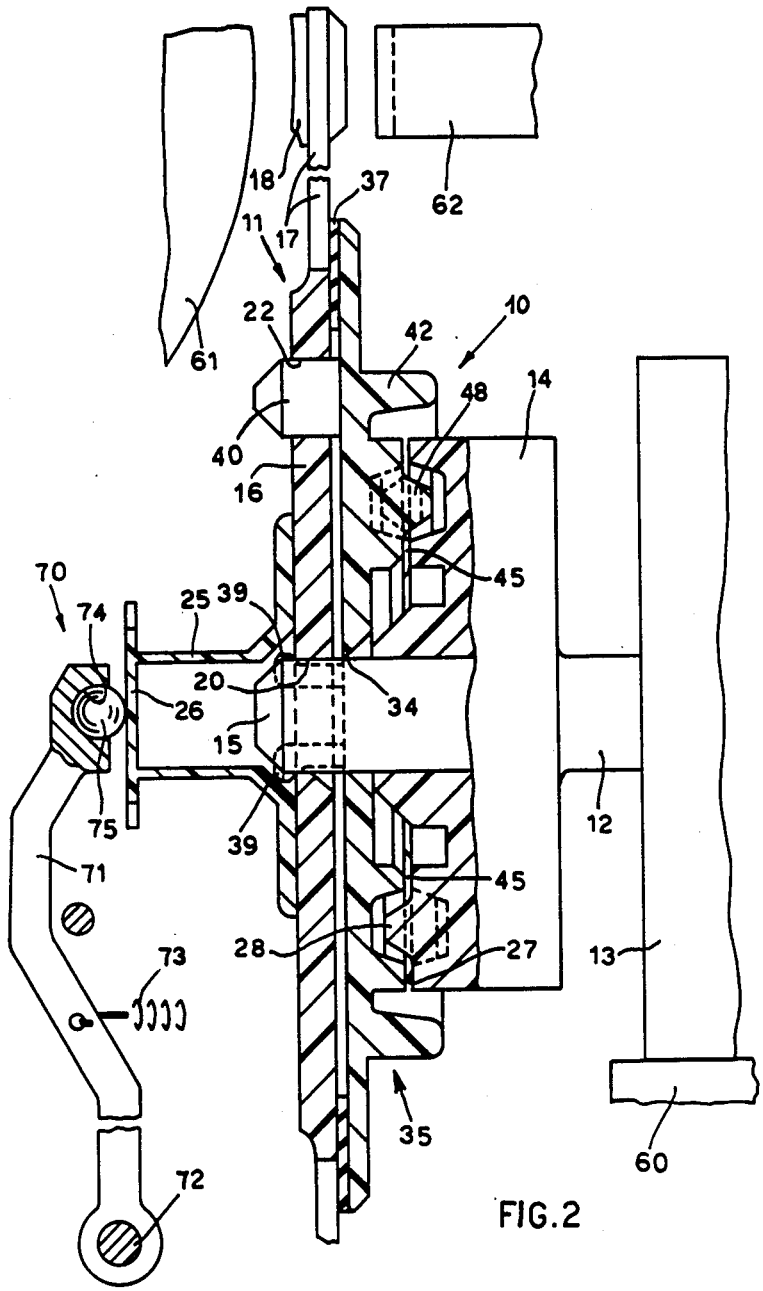
Figure 3:
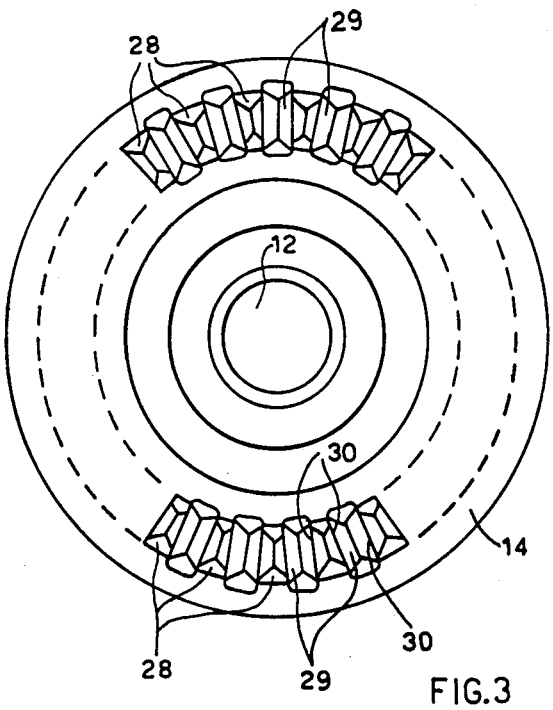
Figure 4:
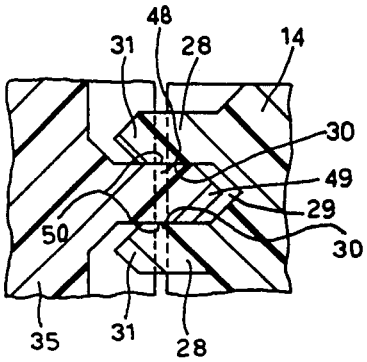
Figure 5:
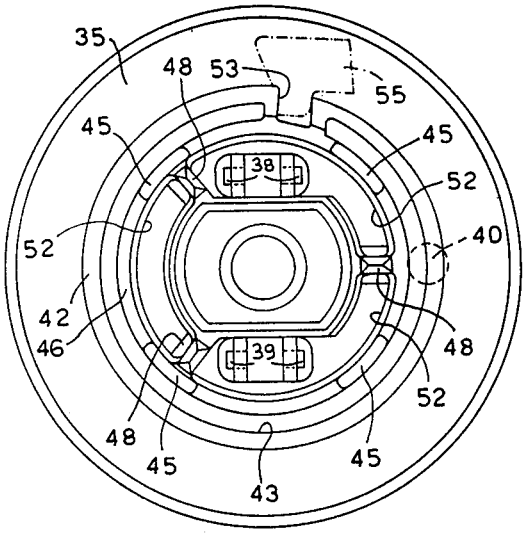
Figure 6:
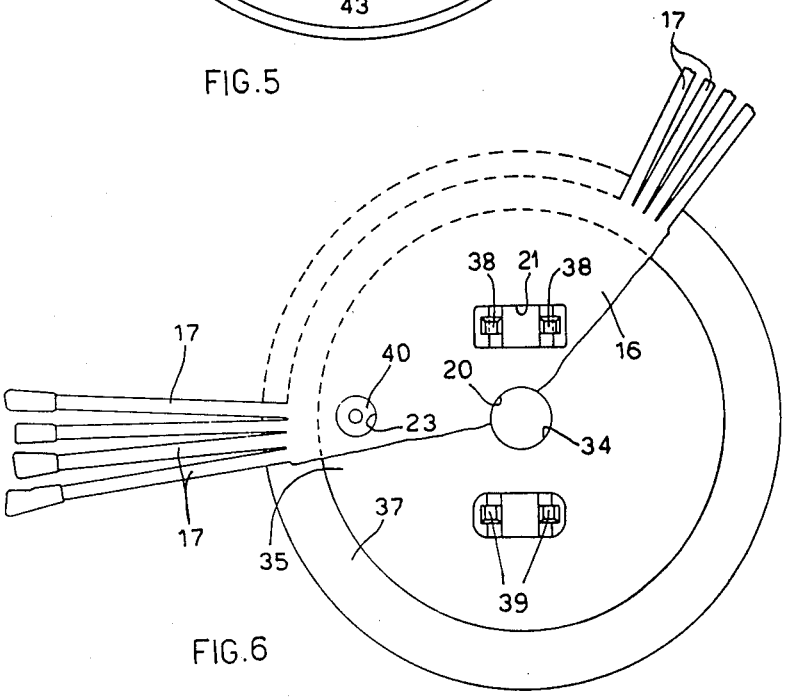
Figure 7:
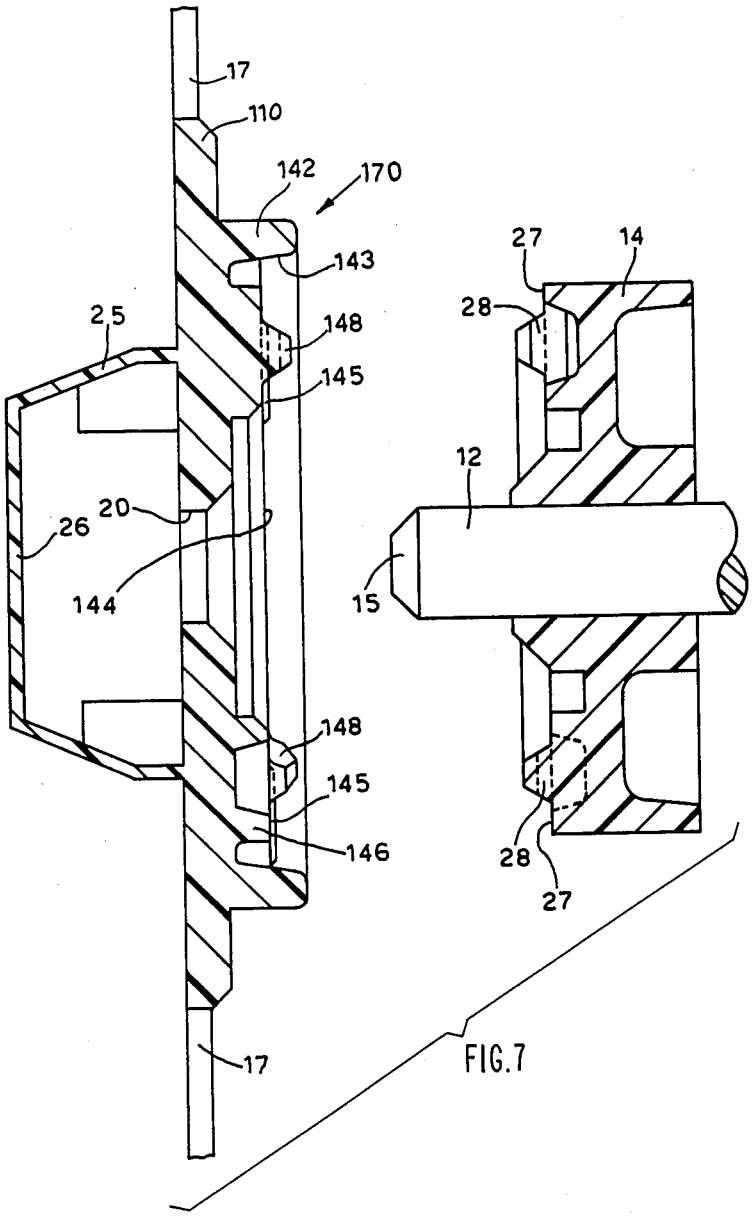
Figure 8:
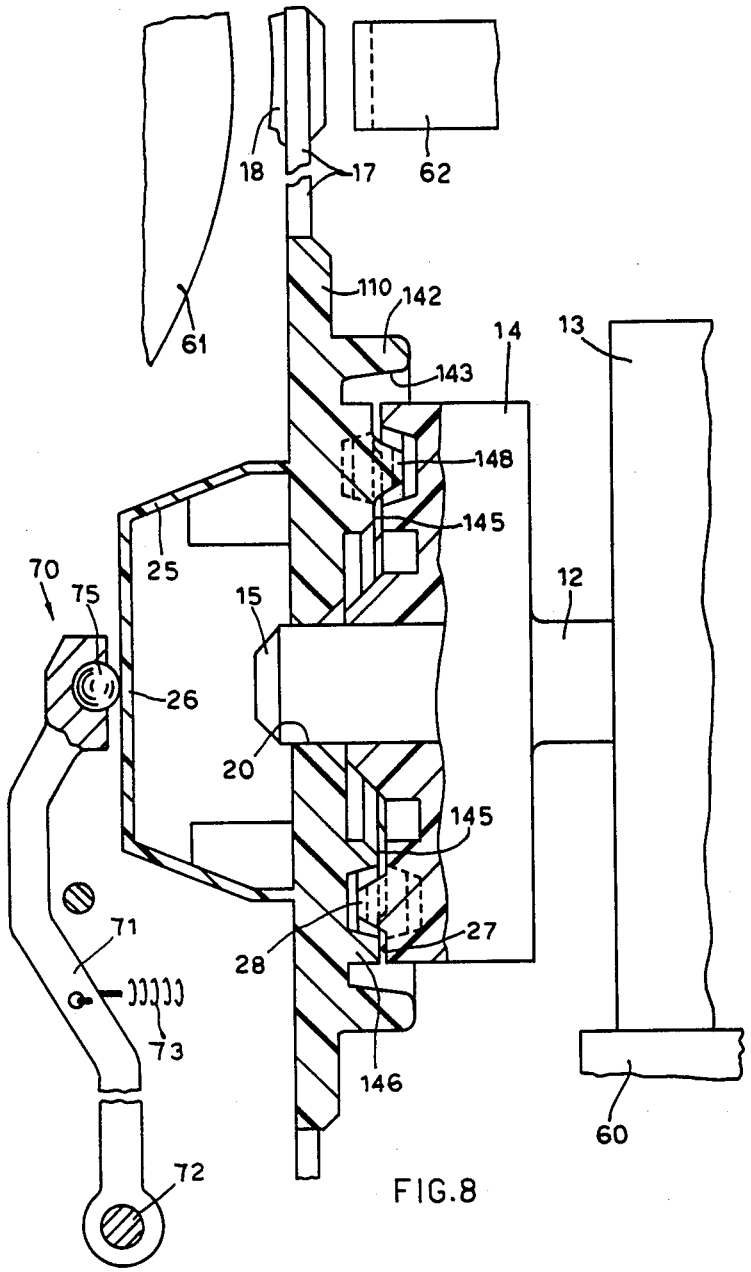

These and other features of the invention will be clearly apparent from the following description of two preferred embodiments, which are given by way of non-limiting example, with reference to the accompanying drawings in which:

FIG. 1 is a sectional side view of a first embodiment of a device according to the invention, with the elements thereof in the disengaged condition, FIG. 2 is a partly sectional side view of the device shown in FIG. 1, with the components thereof coupled together, FIG. 3 is a front view of a component of the device shown in FIG. 1, FIG. 4 is a view of a detail in section and on an enlarged scale of the device according to the invention, FIG. 5 is a front view of another component of the device shown in FIG. 1, FIG. 6 is another front view in partial section of the component shown in FIG. 5, FIG. 7 is a sectional side view of a second embodiment of a device according to the invention, with the components in the disengaged condition, and FIG. 8 is a partly sectional side view of the device shown in FIG. 7 with the components thereof coupled together.

Referring to FIGS. 1 to 6, a device 10 according to the present invention, in its first embodiment, is shown fitted in an electronic typewriter of known type, for example of the type described in our British patent specification No. GB 2 031 626, for coupling a character-carrying disc 11 to the shaft 12 of an electric selector motor 13 of stepping type. The typewriter comprises inter alia a carriage 60 on which the motor 13 is mounted, a platen roller 61 and a striker hammer 62. The motor 13 and the hammer 62 are arranged to be manually spaced away from the roller 61 in any known manner to permit the disc 11 to be fitted into and removed from the machine.

The character-carrying disc 11 is also of known type, for example of the type described in the U.S. Pat. No. 4,036,348 assigned to Ing. C. Olivetti & C., S.p.A. comprising a central hub portion 16 of plastics material, and one hundred radial, flexible blade portions 17, at the end of each of which is provided a raised print character 18.

The central hub portion 16 is provided with a central hole 20 therethrough, being of the same diameter as the motor shaft 12, a cylindrical hole 22 for angular positioning of the disc, and two cavities 21 and 23 of substantially rectangular section which are disposed on diametrically opposite sides with respect to the central hole 20. A gripping handle 25 having a front wall portion 26 is fixed to the central hub portion 16 of the disc 11.

The device 10 comprises a flange 14 of plastics material, which is fixed to the shaft 12 in such a way that a frustoconical end portion 15 of the shaft 12 projects outwardly with respect to the flange 14.

The flange 14 (see FIGS. 1 and 3) is provided on a front surface 27 thereof with a ring of radial, angularly equally spaced teeth 28 between which are defined recesses 29.

The teeth 28 are so shaped as to provide a wedge-shaped leading portion 31 (see FIGS. 3 and 4) and side surfaces 30, or active side faces, which are perpendicular to the front surface 27. In addition, the side surfaces 30 which define each recess 29 are parallel to each other and parallel to the radial line passing through the recess, so that the cross-section of each recess 29 is substantially rectangular.

There are twenty five teeth 28 and the number thereof is selected in dependence on the characteristics of the stepping motor 13, as will be seen in greater detail hereinafter.

The flange 14 with its teeth 28 and the recesses 29 forms one of the active elements of the coupling which is to be made between the character-carrying disc 11 and the motor shaft 12.

The second active component of the coupling arrangement, which is intended precisely to couple to the flange 14, comprises a disc 35 (see FIGS. 1, 2, 5 and 6) of plastics material, which is so shaped as to engage on one hand with the character-carrying disc 11 and on the other hand with the flange 14.

More particularly, the disc 35 comprises a central hole 34 therethrough, being slightly larger in diameter than the diameter of the shaft 12 and the diameter of the hole 20. Fixed to a first front surface 36 of the disc 35 is a rubber ring 37 which is arranged to contact the central hub portion 16 of the character-carrying disc 11.

Two pairs of hook portions 38 and 39 project perpendicularly from the surface 36 and are arranged to engage respectively into the cavities 21 and 23 in the disc 11 to connect the two discs 11 and 35 together. A cylindrical pin portion 40 for angular positioning purposes is arranged to co-operate with the hole 22 in the disc 11 for angular positioning of the two discs 11 and 35 relative to each other.

On the side opposite to the surface 36, the disc 35 is so shaped as to provide an external ring portion 42 which defines a cylindrical cavity 43, within which there is a second ring portion 46 whose outside diameter is substantially equal to the outside diameter of the flange 14. Provided on a front surface 44 of the ring portion 46 are four counteracting elements 45 cooperable with the front surface 27 of the flange 14.

Provided within the ring portion 46 are three radial teeth 48 which are angularly spaced from each other in such a way as always to be capable of engaging with three recesses 29 in the flange 24. Each tooth 48 also has a leading wedge-shaped portion 49 and the side surfaces 50, or active side surfaces thereof, which are perpendicular to the front surface 44, parallel to each other and parallel to the radial line passing through the tooth. Cutout sectors 52 are provided between the teeth 48 to accommodate the teeth 28 of the flange 14.

A radial recess 53 is provided on the periphery of the ring portion 42 and is co-operable with an angular positioning element 55, as will be described hereinafter.

The mode of opeation of the above-described device is as follows:

Before coupling the character-carrying disc 11 to the shaft 12 of the stepping motor 13, the connection is made between the discs 11 and 35. In fact, in this first embodiment, the disc 35 is an accessory of the character-carrying disc 11 and it is essential for them to be coupled together before the disc 11 is fitted into the typewriter.

The two discs 11 and 35 are coupled together in a simple manner, by first positioning them coaxially relative to each other and then positioning them angularly, by inserting the pin portion 40 into the hole 22 and then, with a slight axial movement, engaging the pairs of hook portions 38 and 39 into the cavities 21 and 23 respectively.

Once the disc 11 is coupled to the disc 35, the disc 11 is fitted vertically into the machine from above between the platen roller 61 and the hammer 62. Before the disc 11 is fitted in that way however, the motor 13 and the hammer 62 are moved rearwardly with respect to the platen roller 61 (towards the right in FIG. 2) by the operator.

Movement of the hammer 62 and the motor 13 is produced by means of mechanisms with which the machine is provided and which are not described herein for the sake of brevity, and also because such mechanisms are not relevant to the purposes of the device according to the invention.

When the disc 11 is fitted into the machine, it bears with the wall portion 26 of its gripping handle 25 against a counteracting member 70 which is formed for example by a lever 71 pivoted on a pin member 72 of the carriage 60 and urged constantly towards the motor 13 by a spring 73. Provided on the upper end of the lever 71 is a seat 74 within which a metal ball 75 is rotatable.

In that position, the disc 11 and the disc 35 are roughly positioned with respect to the axis of the shaft 12 of the motor 13, with the teeth 48 disposed substantially in front of the teeth 28 of the flange 14.

The motor 13 is then returned towards its stable operating position (shown in FIG. 2) by operating the appropriate mechanisms of the machine, thus forming the connection between the flange 14 and the disc 35. More particularly, when the motor 13 with its shaft 12 and the flange 14 are moved axially towards the disc 11 (towards the left in FIG. 2), the frustoconical portion 15 of the shaft 12 is first inserted with slight clearance into the central hole 34 in the disc 35 and then, with precision, into the central hole 20 in the character-carrying disc 11, thus positioning the disc 11 precisely coaxial with respect to the shaft 12.

The flange 14, continuing its axial movement towards the disc 35, then moves three of its recesses 49 into engagement with the three teeth 49 on the disc 35.

Such interengagement takes place without excessive force as between the flange 14 and the disc 35, since both the ends 31 of the teeth 28 and the ends 49 of the teeth 48 are of wedge shape. In addition, since the active side surfaces 50 of the teeth 48 are parallel to each other and orthogonal to the front surface 44, and with the internal side surfaces 30 of the recesses 29 also being parallel to each other and orthogonal to the front surface 27, and with the front surfaces 27 and 44 being parallel to each other, interengagement as between the teeth 48 and the recesses 29 takes place in a highly precise manner. In addition, since the three teeth 48 of the disc 35 are angularly disposed at substantially 120° from each other, precise interengagement thereof with three of the recesses 29 in the flange 14 also ensures that the disc 35 is coaxial with respect to the flange 14. In that way, when the connection has been made, the disc 11, the disc 35 and the flange 14 are perfectly coaxial with each other.

When axial movement of the motor 13 and the flange 14 is concluded, the connection between the disc 35 and the flange 14 is secured by the axial thrust produced by the ball 75 by means of the spring 73.

Since the connection between the discs 11 and 35 on the one hand and the flange 14 on the other hand is produced in the angular respect in a casual manner, with no member for predetermining the mutual angular positioning thereof, the electronic components which control the rotary movement of the motor 13 and actuation of the hammer 62, such electronic components not being shown in the drawings, must be given a precise indication of the reference or zero position of the disc 11 and the motor shaft 12.

To do that, the stepping motor 13 is actuated so as to rotate the shaft 12 and the components connected thereto, that is to say, the flange 14, the disc 35 and the character-carrying disc 11. Such rotary movement continues until the tooth of the element 55 engages into the radial recess 53 (see FIG. 5). The element 55 is controlled in known manner, for example as described in U.S. Pat. No. 4,605,324 assigned to Ing. C. Olivetti & C., S.p.A.

When the element 55 has stopped the rotary movement of the disc 35, the shaft 12 also stops, even if the windings of the motor 13 continue to be energised. When a predetermined period of time from the commencement of such rotary movement has elapsed, control pulses cease to be applied to the motor 13 and the position reached is assumed as the reference position.

In that position, the character-carrying disc 11 is firmly in a predetermined angular position.

As already indicated hereinbefore, the number of recesses 29 on the flange 14 is selected in dependence on the characteristics of the stepping motor 13. Thus, if for example a four phase motor is used and if a complete revolution is performed, by effecting one hundred elementary steps, that is to say, in such a way that each step thereof corresponds to the angular displacement of a character 18 of the disc 11, there are twenty five recesses 29 in the flange 14. That number is given by the ratio between the number of steps of the motor (100) and the number of phases thereof (4).

That choice is such that, when the disc 35 is fixed in the predetermined reference position by means of the element 55, the rotor of the motor 13 is also fixed in one of the twenty five possible positions with which a predetermined phase is associated. In that way, even if the connection between the disc 35 and the flange 14 is made with casual angular phase positioning, stopping of the motor 13 in a phase preselected from the four possible phases will always correspond to the reference position of the character-carrying disc 11.

In order to disconnect the disc 35 from the flange 14 and thus from the motor 13, the motor merely has to be displaced rearwardly (towards the right in FIG. 2) with respect to the carriage 60.

In accordance with a second embodiment (see FIGS. 7 and 8), the device for connecting a character-carrying disc 11 to the shaft 12 of a selector motor 13 comprises a flange 14 which is exactly the same as that described hereinbefore, and connecting means 170 formed integrally on the disc 110, for example during the operation of moulding or pressing same.

The coupling means 170 are in practice the same as those that the above-described disc 35 carries, disposed on the front surface thereof which is opposite to the surface 36, and comprise therefore a ring portion 142 defining a cylindrical cavity 143 within which there is a second ring portion 146 whose outside diameter is substantially equal to the outside diameter of the flange 14. Provided on a front surface 144 of the ring portion 146 are four counteracting elements 145, of which two are shown in the drawings, being capable of co-operating with the front surface 27 of the flange 14. Provided within the ring portion 146 are three radial teeth 148, two of which are shown in the drawings and which are angularly spaced so as to be capable of always engaging with three recesses 29 in the flange 14. The teeth 148 are of the same shape as the teeth 48.

A radial recess (not shown) is provided at the periphery of the ring portion 142 to co-operate with the angular positioning element 55.

The character-carrying disc 110 is fitted into the typewriter between the counteracting element 70 and the motor 13 and is connected to the shaft 12 in the same manner as already described hereinbefore in regard to inserting and connecting the discs 11 and 35 with the flange 14.

This second embodiment has the advantage of not having two separate components which have to be pre-engaged together before the character-carrying disc is fitted into the machine.

It will be apparent that the above-described devices for coupling a character-carrying disc to a selector motor may be the subject of modifications and additions of parts, without thereby departing from the scope of the present invention.

For example,, a single tooth 48, 148 may be provided for connecting to one of the radial recesses 29 in the flange 14. In that case, coaxial positioning of the disc 35 with respect to the shaft 12 is effected by making the central hole 34 of the same diameter as the shaft 12.

In addition for example, the recesses 29 may be provided on the disc 35 and the teeth 48 on the flange 14.

We claim:

1. In a device for coupling a character-carrying disc to a motor shaft of a selector motor of a printing machine, wherein said motor shaft comprises a terminal portion, a flange frontal surface and a plurality of angularly equally spaced recesses spaced apart by intervening radial teeth having a wedged configuration, and wherein said character-carrying disc comprises a hub element having a central hole for being coupled exactly with said terminal portion of the motor shaft, a hub frontal surface and at least one tooth for bearing on said flange frontal surface and engaging one of said recesses, resepctively, the combination wherein the printing machine comprises a stop element for stopping said character-carrying disc in a predetermined angular position, wherein said selector motor is a stepping motor having a predetermined number of phases and a predetermined number of steps within the limits of the full circle, wherein the number of said recesses is equal to the ratio between said predetermined number of steps and said predetermined number of phases, wherein each one of said recesses of said flange member has a corresponding radial line and two lateral surfaces parallel to each other parallel to said corresponding radial line and perpendicular to said flange front surface, wherein said one tooth of said hub element has a tooth radial line and two lateral surfaces parallel to each other, parallel to said tooth radial line, and perpendicular to said hub frontal surface, so that both said recesses and said tooth have the same rectangular cross section which facilitates the coupling between said tooth and one of said recesses.

wherein said flange member includes a peripheral annular portion having an edge defining said flange frontal surface, and wherein said hub element is provided in said hub frontal surface with frontal counteracting elements which bear against the edge of said peripheral annular portion when said character-carrying disc is coupled to said motor shaft ensuring parallelism of said disc with the flange frontal surface of said flange member, wherein, when said character-carrying disc is coupled to said motor shaft, the stopping of said stepping ins a predetermined preferential phase among said number of phases corresponds to the stopping of said character-carrying disc in one preferential angular position among a number of preferential angular positions equal to the number of said recesses, and wherein said hub element comprises a peripheral cylindrical wall having a cavity in which lie said at least one tooth, cutout sectors adjacent to said at least one tooth and said counteracting elements, wherein said cavity accommodates the recesses, the intervening radial teeth and the edge of said flange member when the character-carrying disc is coupled to said motor shaft and wherein said cylindrical wall further includes externally a reference recess to be engaged by said stop element for the stopping of said disc in a zero position unequivocally associated with said one preferential angular position and said predetermined preferential phase.

2. A device according to claim 1, wherein both said radial teeth of said flange means and said tooth of said hub element have leading wedge-shaped portions.

3. A device according to claim 1, wherein said hub element is an integral part of said character-carrying disc.

4. A device according to claim 1, wherein said hub element comprises three radial teeth spaced at substantially 120° intervals, and wherein all said three radial teeth have the same rectangular cross section.

5. In a device for coupling a character-carrying disc to a motor shaft of a selector motor of a printing machine, wherein the printing machine comprises a stop element for stopping said character-carrying disc in a predetermined angular position, wherein said motor shaft comprises a terminal portion, a flange member fixed to said shaft and extending radially outwardly from said shaft, and having a flange frontal surface and a plurality of angularly equally spaced recesses spaced by intervening radial teeth, and wherein said character-carrying disc comprises a hub element having a central hole for being coupled exactly with the terminal portion of said motor shaft, a hub frontal surface and at least one tooth for cooperating with said flange frontal surface and engaging one of said recesses, respectively, the combination wherein, said selector motor is a stepping motor having a predetermined number of phases and a predetermined number of steps within the limits of the full circle, wherein the number of said recesses is equal to the ratio between said predetermined number of steps and said predetermined number of phases, wherein each one of said recesses of said flange member has a corresponding radial line and two lateral surfaces parallel to each other, parallel to said corresponding radial line and perpendicular to said flange frontal surface, wherein the at least one tooth of said hub element has a tooth radial line and two lateral surfaces parallel to each other, parallel to said tooth radial line of said hub element, and perpendicular to said hub frontal surface, so that said recesses and said one tooth have the same rectangular cross section which facilitates the coupling between said one tooth and one of said recesses, wherein said flange member includes a peripheral annular portion having an edge defining said flange frontal surface, and wherein said hub element is provided in its hub frontal surface with frontal counteracting elements which bear against the edge of said peripheral annular portion when said character-carrying disc is coupled to said motor shaft ensuring parallelism of said disc with the flange frontal surface of said flange member, wherein, when said character-carrying disc is coupled to said motor shaft, the stopping of said stepping motor in a predetermined preferential phase among said number of phases corresponds to the stopping of said character-carrying disc in one preferential angular position among a number of preferential angular positions equal to the number of said recesses, wherein said hub element comprises a peripheral cylindrical wall having a cavity in which lie said one tooth cutout sectors and said counteracting elements, wherein said cavity accommodates the recesses, the intervening radial teeth and the edge of said flange member when the character-carrying disc is coupled to said motor shaft and wherein said cylindrical wall includes externally a reference recess to by engaged by said stop element for the stopping of said disc in a zero position unequivocably associated with said one preferential angular position and said predetermined preferential phase, wherein said hub element comprises a second disc coaxially and removably coupled to said character-carrying disc, and said character-carrying disc comprises a central hub portion having a central hole for being exactly coupled with the terminal portion of said motor shaft, two coupling opening diametrically oppositely disposed with respect to said central hole and a dragging opening, wherein said second disc has its outside diameter substantially equal to the central hub portion of said character-carrying disc and includes a central through hole for accommodating the terminal portion of said motor shaft, said hub frontal surface on one of two opposite surfaces, a dragging pin and two flexible locking elements projecting from a back surface of the two opposite surfaces of said second disc, wherein said dragging pin is engageable with said dragging opening and said flexible locking elements are engageable with said coupling openings for contacting the back surface of said second disc with a front surface of the central hub of the character-carrying disc and wherein said cylindrical wall projects from the other surface of said second disc beyond said counteracting elements.

6. A device for coupling a character-carrying disc to a motor shaft of a selector motor of a printing machine, wherein a stop element is provided for stopping said character-carrying disc in a predetermined angular position, wherein said motor shaft comprises a terminal portion, a flange member fixed on said motor shaft and extending outwardly from said shaft and having a flange frontal surface and a plurality of angularly equally spaced recesses spaced by intervening radial teeth, wherein said character-carrying disc comprises a hub frontal surface to be disposed parallel to said flange frontal surface of said flange member when said character-carrying disc is coupled to said motor shaft and a central hub portion having a central hole to engage exactly with the terminal portion of said motor shaft, two coupling openings disposed with respect to said central hole and a dragging opening on said hub frontal surface, said device comprising:

an intermediate disc having its outside diameter substantially equal to the central hub portion of said character-carrying disc, and two mutually parallel frontal surfaces and including:

a central through hole to accommodate the terminal portion of said motor shaft, a dragging pin and two flexible locking elements integrally formed on and protruding from one of said two mutually parallel frontal surfaces, wherein said dragging pin is engageable with said dragging opening and said flexible locking elements are engageable with said two coupling openings for removably coupling said intermediate disc to said character-carrying disc;

a peripheral ring fixed to one of said two mutually parallel frontal surfaces, and arranged to cooperate with the central hub portion of said character-carrying disc upon the engagement of said flexible locking elements with said coupling openings;

at least one tooth integrally formed on said intermediate disc and protruding from said other surface for engaging the recesses of said flange member, each one of the recesses of said flange member having a radial line and two lateral surfaces parallel to each other, parallel to said radial line and perpendicular to said flange frontal surface, said one tooth of said intermediate disc having a tooth radial line and two lateral surfaces parallel to each other, parallel to said tooth radial line of said intermediate disc and perpendicular to said two mutually parallel frontal surfaces, so that both said recesses and said one tooth have the same rectangular cross section which facilitates the coupling between said tooth and one of said recesses;

a plurality of counteracting elements for engaging with said flange frontal surface when the disc is coupled to said motor shaft; and a peripheral cylindrical wall having a cavity in which lie said counteracting elements and including externally a recess to be engaged by said stop element for the stopping of said disc in said predetermined angular position of the disc.

7. A device according to claim 6, wherein said flexible locking elements comprise two pairs of resilient hook portions cooperable with said two coupling openings of said hub portion.

8. A device according to claim 6, wherein said selector motor is a stepping motor having a predetermined number of phases and a predetermined number of steps within the limits of the full circle, and wherein the number of said recesses is equal to the ratio between said predetermined number of steps and said predetermined number of phases, and wherein said predetermined angular position of the disc is unequivocably associated with a predetermined phase of said stepping motor.

9. A device for coupling a character-carrying disc to a motor shaft of a selector motor of a printing machine, wherein the printing machine comprises a stop element for stopping said character-carrying disc in a predetermined angular position, wherein said motor shaft comprises a terminal portion, a flange member fixed on said motor shaft and projecting radially from said motor shaft and having a flange frontal surface and a plurality of angularly equally spaced recesses, and wherein said character-carrying disc comprises a flange frontal surface to be disposed parallel to said first frontal surface of said flange member when said character-carrying disc is coupled to said motor shaft and a central hub portion having a central hole for being coupled exactly with the terminal portion of said motor shaft, two coupling openings diametrically oppositely disposed with respect to said central hole and a dragging opening on said hub frontal surface, wherein said selector motor is a stepping motor having a predetermined number of phases and a predetermined number of steps within the limits of the full circle, wherein the number of said recesses is equal to the ratio between said predetermined number of steps and said predetermined number of phases said device further comprising:

an intermediate disc having its outside diameter substantially equal to the central hub portion of said character-carrying disc, and two mutually parallel frontal surfaces and including:

a dragging pin and two flexible locking elements integrally formed on and protruding from one of said two mutually parallel frontal surfaces, wherein said dragging pin is engageable with said dragging opening and said flexbile locking elements are engageable with said two coupling openings for removably coupling said intermediate disc to said character-carrying disc;

a peripheral rubber ring fixed to said one of said two mutually parallel frontal surfaces and arranged to cooperate with the central hub portion of said character-carrying disc upon the engagement of said flexible locking elements with said coupling openings;

a plurality of teeth integrally formed on said intermediate disc and each protruding from said other surface for engaging one of said recesses of said flange member;

a plurality of counteracting elements for engaging with said flange frontal surface when the disc is coupled to said motor shaft; and a peripheral cylindrical wall having a cavity in which lie said counteracting elements and including externally a recess univocally associated with a zero position of said character-carrying disc, wherein an angular stop element is provided to engage the recess of the peripheral cylindrical wall of said intermediate disc for stopping said character-carrying disc in a predetermined angular position, and wherein, when said character-carrying disc is coupled to said motor shaft, the stopping of said stepping motor in a predetermined preferential phase among said number of phases corresponds to the stopping of said character-carrying disc in said zero position.

* * * * *